US008241702B2

(12) United States Patent
Doye et al.

(10) Patent No.: US 8,241,702 B2
(45) Date of Patent: Aug. 14, 2012

(54) METHOD FOR PRODUCING A COATING THROUGH COLD GAS SPRAYING

(75) Inventors: Christian Doye, Berlin (DE); Ursus Krüger, Berlin (DE); Uwe Pyritz, Berlin (DE)

(73) Assignee: Siemens Aktiengesellschsft, Munich (DE)

( * ) Notice: Subject to any disclaimer, the term of this patent is extended or adjusted under 35 U.S.C. 154(b) by 136 days.

(21) Appl. No.: 12/934,902

(22) PCT Filed: Mar. 25, 2009

(86) PCT No.: PCT/EP2009/053504

§ 371 (c)(1),
(2), (4) Date: Sep. 27, 2010

(87) PCT Pub. No.: WO2009/118335

PCT Pub. Date: Oct. 1, 2009

(65) Prior Publication Data

US 2011/0027496 A1 Feb. 3, 2011

(30) Foreign Application Priority Data

Mar. 28, 2008 (DE) ..... 10 2008 016 969

(51) Int. Cl.
*B05D 1/02* (2006.01)
*B05D 5/00* (2006.01)

(52) U.S. Cl. ..... 427/190; 427/191; 427/201; 427/427

(58) Field of Classification Search ..... 427/190, 427/191, 201, 427

See application file for complete search history.

(56) References Cited

U.S. PATENT DOCUMENTS

| | | | | |
|---|---|---|---|---|
| 7,438,948 | B2 * | 10/2008 | Harris et al. | 427/166 |
| 2007/0087187 | A1 * | 4/2007 | Lu et al. | 428/323 |
| 2007/0148363 | A1 * | 6/2007 | Heinrich et al. | 427/427 |
| 2009/0202732 | A1 | 8/2009 | Krüger et al. | |
| 2010/0068140 | A1 | 3/2010 | Hehir et al. | |

FOREIGN PATENT DOCUMENTS

| | | | |
|---|---|---|---|
| DE | 10 2004 038 795 | A1 | 3/2006 |
| DE | 10 2005 005 359 | A1 | 8/2006 |

(Continued)

OTHER PUBLICATIONS

Matthew Hennek, "Nitrogen-Doped Titanium Dioxide:An Overview of Function and Introduction of Applications", Literature Seminar20. Jan. 2007University of Alabama; Others; US.

Chang-Jiu Li et al., "Formation of TiO2 photocatalyst through cold spraying Proc. ITSC," May 10-12, 2004Osaka, Japan; Others.

International Office Action issued Jun. 29, 2009 in corresponding International Patent Application PCT/EP2009/053504.

German Office Action issued Nov. 24, 2008 in corresponding German Patent Application 2008P05629 DE.

*Primary Examiner* — Frederick Parker

(74) *Attorney, Agent, or Firm* — Staas & Halsey LLP

(57) ABSTRACT

The embodiments include a method for producing a coating through cold gas spraying. In the process, particles according to the embodiments are used which contain a photocatalytic material. In order to improve the effect of this photocatalytic material (such as titanium dioxide), a reactive gas can be added to the cold gas stream, the reactive gas being activated by a radiation source not shown, for example by UV light, on the surface of the coating that forms. This makes it possible to, for example, dose titanium dioxide with nitrogen. This allows the production of in situ layers having advantageously high catalytic effectiveness. The use of cold gas spraying has the additional advantage in that the coating can be designed to contain pores that enlarge the surface available for catalysis.

7 Claims, 4 Drawing Sheets

FOREIGN PATENT DOCUMENTS

| | | | |
|---|---|---|---|
| DE | 10 2005 053 263 | A1 | 5/2007 |
| EP | 1 785 508 | A2 | 5/2007 |
| WO | 2007/000422 | A2 | 1/2007 |

* cited by examiner

METHOD FOR PRODUCING A COATING THROUGH COLD GAS SPRAYING

CROSS REFERENCE TO RELATED APPLICATIONS

This application is the U.S. national stage of International Application No. PCT/EP2009/0053504, filed Mar. 25, 2009 and claims the benefit thereof. The International Application claims the benefit of German Application No. 10 2008 016 969.2, filed on Mar. 28, 2008, all applications are incorporated by reference herein in their entirety.

BACKGROUND

1. Field

The embodiments relate to a process for producing a coating on a workpiece by cold gas spraying, in which process a cold gas jet containing particles of a coating material is directed at the workpiece and the workpiece is simultaneously irradiated with electromagnetic radiation.

2. Description of the Related Art

A process of the type indicated in the introduction is known, for example, from DE 10 2005 005 359 A1. In this process, the particles accelerated with the cold gas jet toward the surface of a workpiece to be coated are acted upon by an amount of energy (kinetic energy) which does not suffice, per se, to bring about permanent adhesion of the particles on the surface. Instead, this requires an additional introduction of energy into the coating being formed on the workpiece. This introduction of energy takes place via a laser, the radiation of which is focused exactly at that point at which the cold gas jet impinges on the workpiece.

In principle, the process described can also be used to produce catalytic coatings. For this purpose, it is necessary to select particles with a surface which brings about the desired catalytic action. By way of example, it is possible to produce coatings from a photocatalytic material such as titanium dioxide. In order to improve the catalytic action, it is also possible to use nitrogen-doped titanium dioxide (or titanium oxynitride).

According to DE 10 2004 038 795 B4, it is also known to produce catalytic coatings by means of cold gas spraying. In this context, an oxidic powder is applied to a polymer surface by means of cold gas spraying and forms a mechanically firmly adhering coating. In this case, the photocatalytic properties of the oxidic powder are retained. According to DE 10 2005 053 263 A1, photocatalytically active coatings can also be applied to metallic surfaces by means of cold gas spraying. Since the particles are heated only slightly during cold gas spraying, it is also possible to use modified photocatalytic materials, where the modification is retained in the applied coating. By way of example, a powder containing doped titanium oxide can thus be used. Process parameters for producing titanium dioxide coatings by means of cold gas spraying can also be gathered from Chang-Jiu Li et al. "Formation of TiO2 photocatalyst through cold spraying" Proc. ITSC, May 10-12, 2004, Osaka, Japan.

In order to obtain particles of a nitrogen-doped titanium dioxide, it is also possible, however, to employ a sol-gel process, where titanium dioxide powder is melted at high temperatures in gaseous ammonia. Oxidation of titanium nitride also makes production possible. Another possible way is by ion implantation, magnetron sputtering or PVD processes. The titanium dioxide coatings can be doped with a nitrogen content of 2 to 4.4% using the processes. The production of photocatalytic materials such as nitrogen-doped titanium dioxide therefore requires a certain outlay. Processes of this type are described, for example, in Nitrogen-Doped Titanium Dioxide: An Overview of Function and Introduction to Applications, Matthew Hennek, Jan. 20, 2007, University of Alabama.

SUMMARY

Therefore, an aspect of the embodiments is to specify a process for producing a coating on a workpiece by cold gas spraying, which process makes it possible to produce catalytic coatings having a relatively high degree of efficiency at relatively low cost.

According to the embodiments, this aspect is achieved by the process mentioned in the introduction in that the cold gas jet contains a reactive gas, the particles contain a photocatalytic material and the electromagnetic radiation contains at least one wavelength at which the photocatalytic material can be activated. Furthermore, it is provided according to the embodiments that the intensity of the electromagnetic radiation is set such that the photocatalytic material is activated in the coating which has already formed, and atoms of the reactive gas are incorporated in the photocatalytic material. In this way, the photocatalytic material can advantageously be doped with the atoms of the reactive gas. In this respect, it is precisely the photocatalytic action of the material incorporated in the coating which is utilized according to the embodiments. Specifically, it has been found that the conditions prevailing during the build-up of the coating during cold gas spraying are suitable for modifying a photocatalytic material in the coating by doping with reactive gas fractions from the cold gas jet in situ, as it were, when the coating is being produced. Complicated production of the doped photocatalytic materials is thereby advantageously avoided. Instead, it is possible to introduce the reactive gas into the cold gas jet at low cost and to use the less-expensive, undoped photocatalytic material as coating material.

According to one particular refinement of the embodiments, it is provided that the photocatalytic material is titanium dioxide and the reactive gas used is nitrogen. The nitrogen, which is therefore also available at the site at which the coating is formed, in this case impinges on the photocatalytic titanium dioxide, which has already been photoactivated by the introduction of UV radiation of a suitable wavelength. Nitrogen molecules can thereby be broken down on the surface of the coating and accumulated in the surface of the coating. This process takes place on the basis of the chemisorption mechanism, where the nitrogen can also force oxygen atoms out of the crystal lattice of the titanium dioxide (formation of titanium oxynitride).

According to another refinement of the embodiments, it is provided that the titanium dioxide or the photocatalytic material is present in the coating material in the form of nanoparticles. In this context, it is taken into account that nanoparticles have a pronounced photocatalytic action. In addition, the preferred wavelength of a photocatalytic excitation can be influenced by the size of the nanoparticles.

Since nanoparticles, on account of their extremely low mass, cannot be readily deposited by means of cold gas spraying owing to the introduction of kinetic energy required, it is necessary to cluster the nanoparticles to form agglomerates having larger dimensions. These clusters, which have dimensions in the micrometer range, can be readily processed by means of the cold gas spraying process. However, the microparticles thus formed have a nanostructure which is determined by the nanoparticles used. This nanostructure is retained even after the agglomerates have been deposited on the component to be coated.

It is particularly advantageous if, in addition to the photocatalytic material, the coating material also contains a matrix material, in which the photocatalytic material is incorporated during formation of the coating. By way of example, this matrix material can be fed to the cold gas jet in the form of a second particle type. However, it is advantageously also possible to use a particle type which already contains the components of the matrix material and of the photocatalytic material. In this case, it is particularly advantageous that the matrix material is present in the form of microparticles. Specifically, these ensure that the particles can be processed as already mentioned above by cold gas spraying. The nanoparticles of the photocatalytic material, for example titanium dioxide, can then be applied to the surface of the microparticles. This also ensures that the photocatalytic material used has a high degree of efficiency, since it is present exclusively on the surface of the microparticles and can thus show the action as a catalyst.

In order to ensure that the photocatalytic material has the highest possible degree of efficiency, it is particularly advantageous if the introduction of energy into the cold gas jet is such that pores form between the particles in the coating. This can be achieved by virtue of the fact that although the introduction of energy into the cold gas jet suffices for the coating particles to remain adhering to the component to be coated, the introduction of energy is too low to ensure that the material is significantly compacted during the build-up of the coating. In other words, the coating particles deform only slightly, and therefore hollow spaces remain therebetween. The deformation is just sufficient to ensure that the particles adhere to the surface or to one another. The hollow spaces which remain then form pores or channels, which enlarge the surface of the coating. This surface is then also available for utilizing the catalytic effect of the processed material.

Furthermore, it is advantageous if the workpiece is heated during the coating process. The photocatalytic action for the incorporation of the reactive gas can thereby be promoted additionally for the electromagnetic excitation of the photocatalytic effect. Specifically, the thermal energy is likewise available for the desired reaction.

In addition, it is advantageously also possible for reactive gas radicals to be produced from the reactive gas by an additional introduction of energy into the cold gas jet. This can be achieved, for example, by the application of electromagnetic radio-frequency or microwave radiation. Excitation by UV light or laser light is also conceivable. The energy source has to be selected depending on the reactive gas to be excited. If the correct energy source is selected, the excitation brings about the formation of reactive gas radicals, which are much more likely to react than the reactive gas molecule. If, during the formation of the coating, these reactive gas radicals impinge on the photocatalytic material, which has likewise already been activated, it becomes considerably easier to dope the photocatalytic material with the reactive gas radicals. The incorporation rate of the doping material can thereby advantageously be increased.

BRIEF DESCRIPTION OF THE DRAWINGS

These and other aspects and advantages will become more apparent and more readily appreciated from the following description of the exemplary embodiments, taken in conjunction with the accompanying drawings of which.

DETAILED DESCRIPTION OF THE PREFERRED EMBODIMENT

Figure 1:
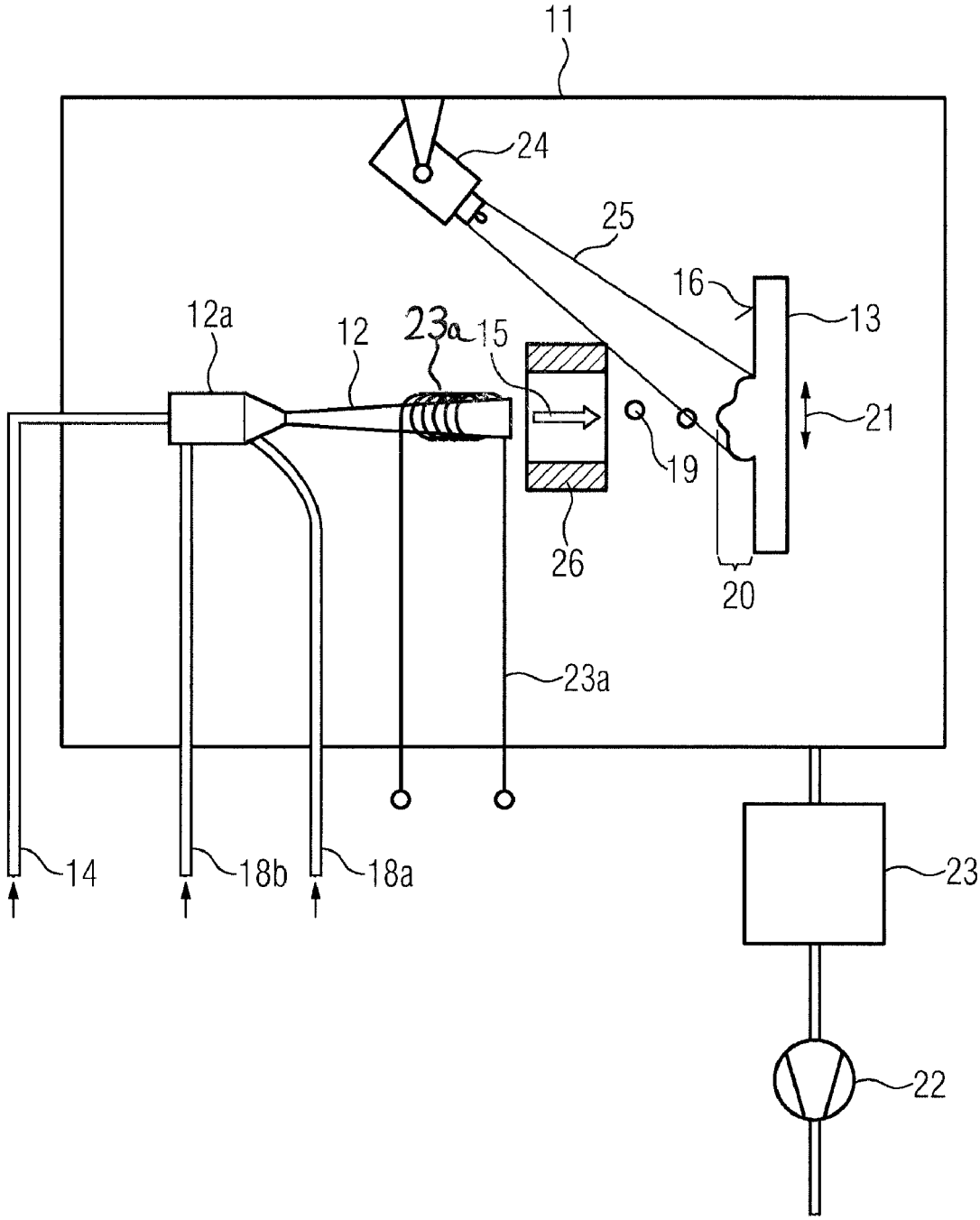
FIG. 1 is a schematic illustration of a cold gas spraying installation which is suitable for carrying out an exemplary embodiment of the process, FIGS. 2 and 3 schematically show particles and the coatings forming therefrom for various exemplary embodiments of the process.

Reference will now be made in detail to the preferred embodiments, examples of which are illustrated in the accompanying drawings, wherein like reference numerals refer to like elements throughout.

FIG. 1 shows a cold gas spraying installation. This has a vacuum chamber 11, in which firstly a cold gas spray nozzle 12 and secondly a workpiece 13 are arranged (fastening not shown in more detail). A process gas containing a reactive gas (for example nitrogen), which is not shown in more detail, can be fed through a first line 14 to the cold gas spray nozzle 12. As indicated by the contour, the cold gas spray nozzle 12 is formed as a Laval nozzle, by which the process gas is made to expand and is accelerated in the form of a cold gas jet (arrow 15) toward a surface 16 of the workpiece 13. In a manner not shown, the process gas is heated in order to make the required process temperature available in a stagnation chamber 12*a* connected upstream from the Laval nozzle 12.

Particles 19, which are accelerated in the cold gas jet 15 and impinge on the surface 16, may be fed through a second line 18*a* to the stagnation chamber 12*a*. The kinetic energy of the particles 19 means that the latter adhere to the surface 16, the reactive gas being incorporated in the coating 20 being formed. To form the coating, the substrate may be moved back and forth in the direction of the double-headed arrow 21 in front of the cold gas spray nozzle 12. During this coating process, the vacuum in the vacuum chamber 11 is constantly maintained by a vacuum pump 22, the process gas being passed through a filter 23 before it is conducted through the vacuum pump 22, in order to separate out particles that have not been bonded to the surface 16 when they impinged on it. If different particles are used for the coating, i.e. particles of a matrix material and particles of a photocatalytic material, these can be fed in at different points of the stagnation chamber 12*a* using a third line 18*b*. The particles of the metallic matrix material can be fed in through the line 18*a*, and the particles of the titanium dioxide, for example, as catalytic material can be fed in through the third line 18*b*. This has the advantage that the photocatalytic material remains in the stagnation chamber for a longer period of time and can therefore be subjected to greater heating by the process gas. In this case, it can be taken into account that the particles of the catalytic material have a higher melting point than the particles of the matrix material, and therefore reliable separation can be ensured by previous heating of these particles.

The particles may be additionally heated within the cold gas spray nozzle 12 by means of a heater 23*a*. This makes an additional introduction of energy possible, and this can be fed to the particles 19 directly as thermal energy or, by expansion in the Laval nozzle, in the form of kinetic energy.

A UV lamp 24, which is directed at the surface 16 of the workpiece 13, is installed in the vacuum chamber 11 as a further energy source. During the formation of the coating 20, the electromagnetic energy ensures that the reactive gas can be embedded in the photocatalytic material. As will be explained in more detail below, the photocatalytic property of the material is utilized in this respect.

In addition, energy can be introduced into the cold gas jet 15 by means of a microwave generator 26. This introduction of energy makes it possible to break the reactive gas down into reactive gas radicals (not shown in more detail). The reactive gas radicals promote the incorporation thereof in the photocatalytic coating.

Figure 2:
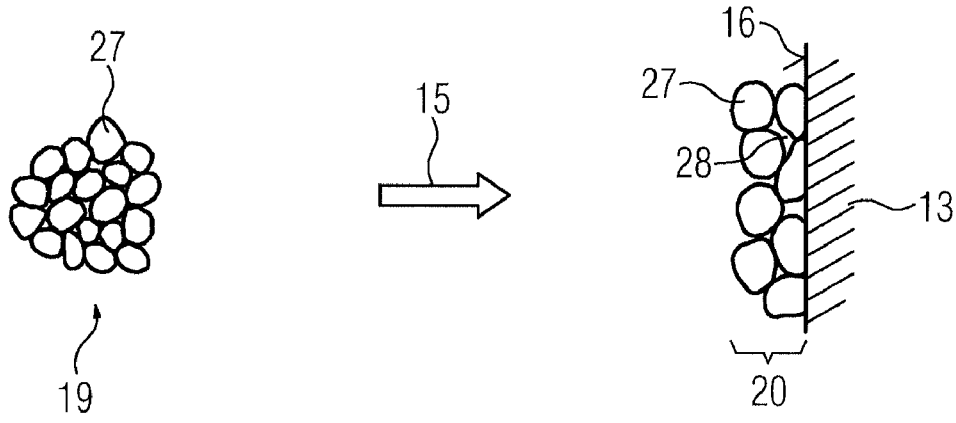

FIG. 2 shows a particle 19 including an agglomerate of nanoparticles of a photocatalytic material 27. If this particle is accelerated in the cold gas jet 15 onto the surface 16 of the workpiece 13, the nanoparticles of the photocatalytic material 27 adhere to the surface, with the coating 20 being formed. It should be recognized that, on account of the coating parameters selected, the kinetic energy of the cold gas jet 15 is not sufficient for the nanoparticles of the photocatalytic material 27 to be compacted, and therefore pores 28 form between the nanoparticles. These pores are available as the surface for the intended photocatalysis. Firstly, in a manner not shown, the reactive gas can also be taken up in the pores, where in this respect it should be taken into account that the accessibility is readily defined by the build-up of the coating currently taking place. The finished coating 20 can then be supplied for its intended use, the pores and the surface of the coating being available for catalysis. By way of example, this could involve a self-cleaning effect of the nitrogen-doped titanium dioxide, which prevents soiling of surfaces.

Figure 3:
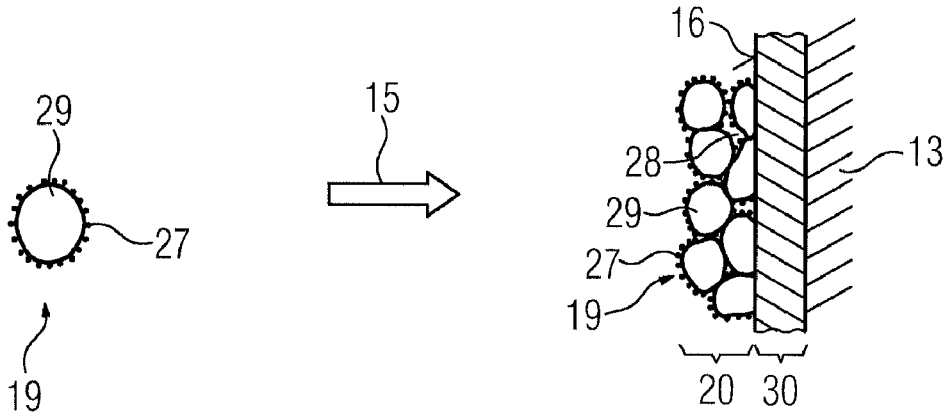

According to FIG. 3, the coating particle 19 includes the matrix material 29, where nanoparticles of the photocatalytic material 27 have been applied to the surface of the matrix material. The particle of the matrix material 29, for example a metal, has dimensions in the micrometer range.

It can likewise be gathered from FIG. 3 that the particles 19 in turn form the coating 20, pores 28 being formed between the particles 19. The walls of these pores are covered with the catalytic material 27, and so this material can be used effectively. There is no photocatalytic material within the particles 19.

It can furthermore be gathered from FIG. 3 that it is also possible to produce multi-layer coatings by means of cold gas spraying. A base layer 30 of the matrix material has first of all been produced on the workpiece 13, where in this case the coating parameters were set such that the particles were compacted and a solid coating was thus produced. Since it was not possible for a photocatalytic material to show any effect in this region of the coating, particles which contained no photocatalytic material were used. Only the coating 20 is built up in the manner already described, the thickness of the coating being selected such that accessibility of the photocatalytic material 27 is ensured by the formation of pores over the entire thickness. In a manner not shown, the coating 20 can also be in the form of a gradient coating.

Figure 4:
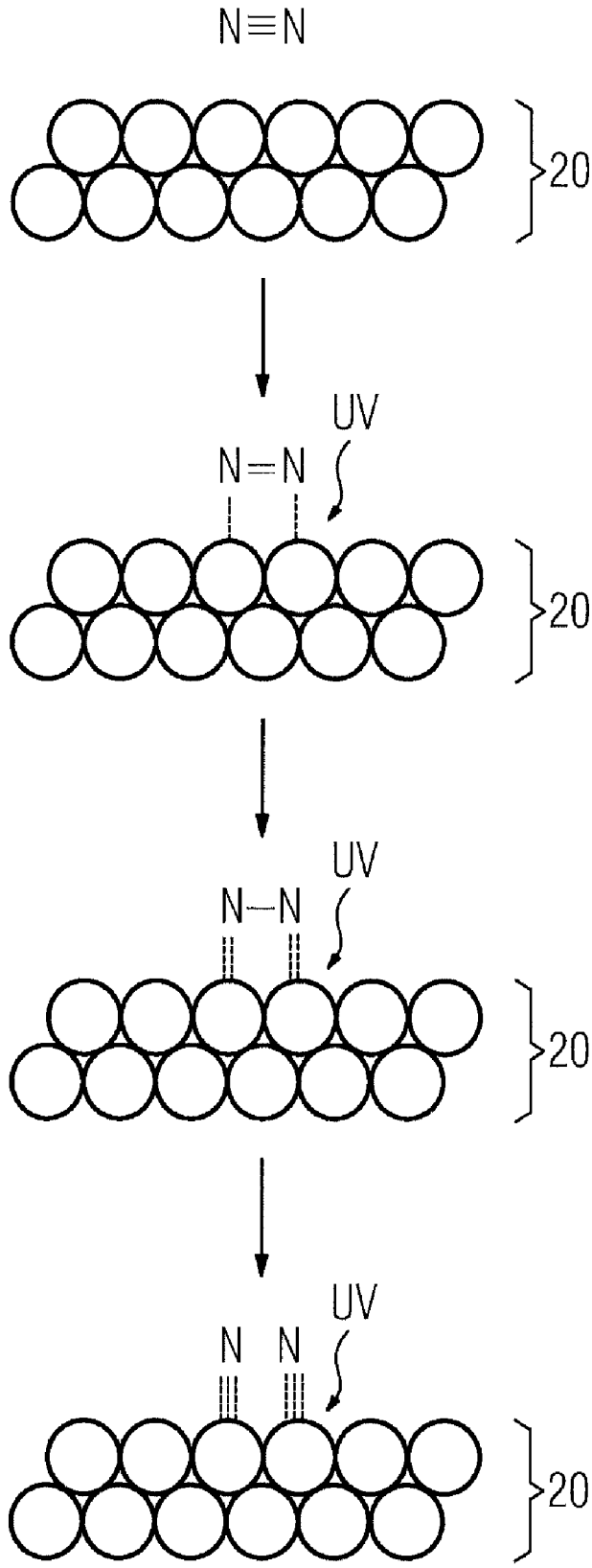
FIGS. 4 and 5 show different accumulation mechanisms of nitrogen during the doping of titanium dioxide in the exemplary embodiment of the process for producing doped titanium dioxide or titanium oxynitride.

FIG. 4 schematically shows how nitrogen, the reactive gas, can be taken up on the surface of the coating 20 by chemisorption under the action of UV light. In this case, the bonds of the nitrogen molecule are gradually broken up and the individual nitrogen atoms are taken up on the surface of the coating 20.

Figure 5:
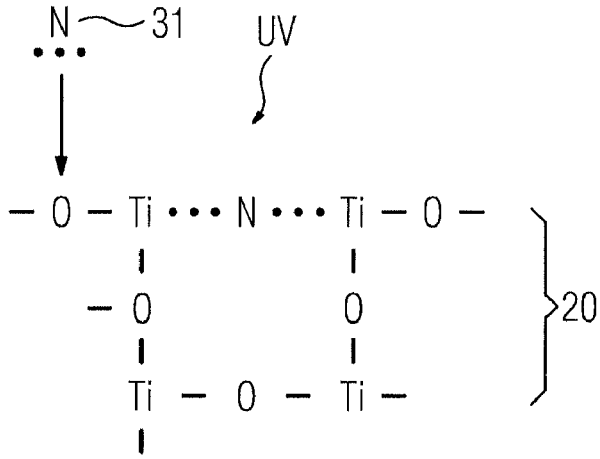

On the basis of titanium dioxide as an example of the photocatalytic material, FIG. 5 schematically shows that oxygen atoms (O) can be displaced by the chemisorption of nitrogen atoms (N). Titanium oxynitride ($TiO_{2-x}N_x$) is thereby produced. This process can be promoted if the reactive gas contains radicals 31.

Figure 6:
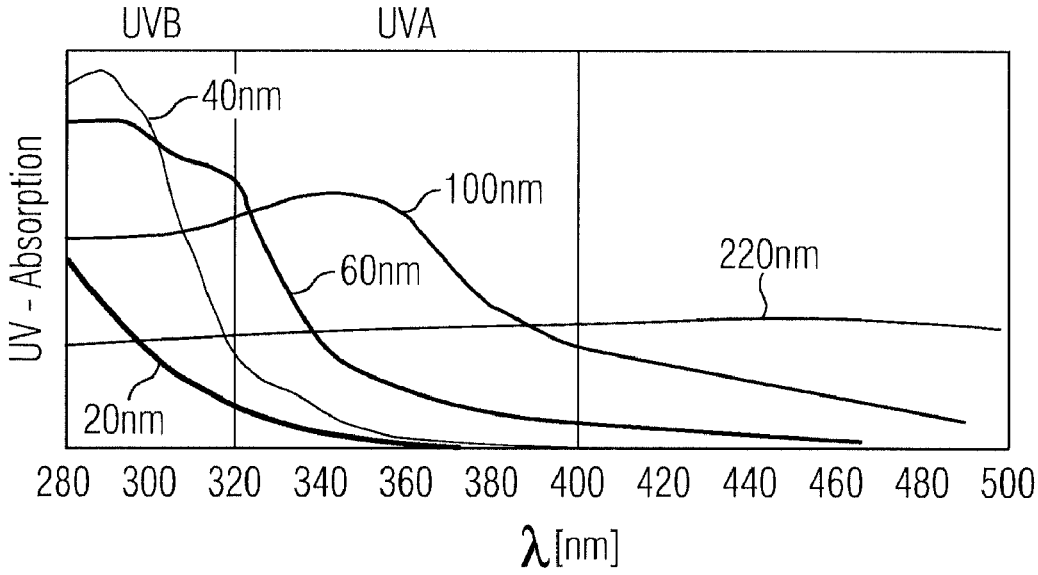
FIG. 6 shows absorption spectra of titanium dioxide having different particle sizes for UV light.

As can be gathered from FIG. 6, the absorption spectrum of UV light can be influenced by the selection of classes of diameter of the photocatalytic nanoparticles of titanium dioxide. It can be seen that there is a tendency for the preferred wavelength of an excitation to increase with the mean diameter of the particles. Therefore, the preferred excitation wavelengths in the case of nanoparticles having a diameter of 40 to 60 nanometers are in the UVB range, and in the case of nanoparticles having diameters of up to 100 nanometers are in the UVA range. This means that, in the case of known mean diameters of the photocatalytic material used, an optimum result in relation to the doping with the reactive gas is obtained if the emission spectrum of the UV lamp 24 is set to the maximum in the respective absorption spectrum. In this respect, it should be noted that the selection of the diameter of the nanoparticles of the catalytic material is also dependent on the intended application of the coating. This will be the decisive criterion for the design.

A description has been provided with particular reference to preferred embodiments thereof and examples, but it will be understood that variations and modifications can be effected within the spirit and scope of the claims which may include the phrase "at least one of A, B and C" as an alternative expression that means one or more of A, B and C may be used, contrary to the holding in *Superguide v. DIRECTV,* 358 F3d 870, 69 USPQ2d 1865 (Fed. Cir. 2004).

The invention claimed is:

1. A process for producing a coating on a workpiece by cold gas spraying, comprising:

directing a cold gas jet comprising particles of a coating material at the workpiece; and simultaneously irradiating the workpiece with electromagnetic radiation, wherein the cold gas jet comprises a reactive gas, the particles comprise a photocatalytic material, and the electromagnetic radiation comprises at least one wavelength at which the photocatalytic material can be activated, and wherein an intensity of the electromagnetic radiation is set such that the photocatalytic material is activated in the coating which has already formed, and atoms of the reactive gas are incorporated in the photocatalytic material.

2. The process as claimed in claim 1, wherein the photocatalytic material comprises titanium dioxide and the reactive gas comprises nitrogen.

3. The process as claimed in claim 1, wherein the photocatalytic material is present in the coating material in the form of nanoparticles.

4. The process as claimed in claim 1, wherein in addition to the photocatalytic material, the coating material comprises a matrix material, in which the photocatalytic material is incorporated during formation of the coating.

5. The process as claimed in claim 1, wherein the introduction of energy into the cold gas jet is such that pores form between the particles in the coating.

6. The process as claimed in claim 1, wherein the workpiece is heated during the coating process.

7. The process as claimed in claim 1, wherein reactive gas radicals are produced from the reactive gas by an additional introduction of energy into the cold gas jet.

* * * * *